United States Patent [19]

Fox et al.

[11] Patent Number: 4,821,969

[45] Date of Patent: Apr. 18, 1989

[54] ALUMINUM CAN CRUSHER

[75] Inventors: Vernon J. Fox; Darrell G. Fox, both of Langdon, N. Dak.

[73] Assignee: Richard W. Fox, Grand Forks, N. Dak. ; a part interest

[21] Appl. No.: 202,228

[22] Filed: Jun. 3, 1988

[51] Int. Cl.[4] ..... B02L 1/04

[52] U.S. Cl. ..... 241/99; 100/902

[58] Field of Search ..... 100/215, 216, 257, 288, 100/295, 902; 241/99, 186 R

[56] References Cited

U.S. PATENT DOCUMENTS

| | | | |
|---|---|---|---|
| 2,619,150 | 11/1952 | Smith | 241/99 X |
| 3,780,647 | 12/1973 | Reimers | 100/902 X |
| 3,817,169 | 6/1974 | Bischoff | 100/902 X |
| 4,561,350 | 12/1985 | Snoe et al. | 100/902 X |
| 4,606,265 | 8/1986 | Meier | 100/902 X |
| 4,757,758 | 7/1988 | Tondo | 100/215 X |

*Primary Examiner*—Timothy V. Eley
*Attorney, Agent, or Firm*—Kinney & Lange

[57] ABSTRACT

In a can crusher, cans lying in a semicylindrical compaction chamber are crushed between a movable ram and a stationary anvil plate. The ram is driven by a ram rod extending from the ram, a ram rod crank arm pivoted to the ram rod and rotated by a power driven crankshaft. Crushed cans are ejected from between the ram and anvil plate after being crushed, and uncrushed cans are fed to a lengthwise position in the compaction chamber each time the ram moves back from the anvil plate. The uncrushed cans are fed, end to end, into the compaction chamber from a feed tube located above the chamber. The feed tube has a skewer receiving opening provided in it, and a skewer retaining sleeve extends out from the feed tube in surrounding relationship to the opening. The skewer crank arm is fixedly mounted on the crankshaft in fixed angular relationship with respect to the ram rod crank arm. When the ram is in its closest position to the anvil plate, the skewer is clear of the interior surface of the feed tube to allow uncrushed cans to move into contact with a can restricting camming surface of the ram rod, but just before the bottom can slides over the can restricting camming surface of the ram rod, the next-to-the bottom uncrushed can has been impaled by this skewer.

6 Claims, 4 Drawing Sheets

ALUMINUM CAN CRUSHER

BACKGROUND OF THE INVENTION

1. Field of the Invention.

This invention has relation to apparatus for crushing cylindrical cans having frangible side walls, and more specifically to crushing empty, used, aluminum beverage cans.

2. Description of the Prior Art.

It is well known to crush empty beverage cans by squeezing them between two plates. See U.S. Pat. No. 2,128,630 granted Aug. 30, 1938; and U.S. Pat. No. 3,916,780 granted Nov. 4, 1975. Also well known is to crush such cans along their longitudinal axes between an anvil and a ram, and when crushed, allowing the cans to drop out from between the ram and anvil into a storing or receiving receptacle below. See U.S. Pat. No. 4,667,593 granted May 26, 1987; U.S. Pat. No. 3,817,169 granted June 18, 1984; U.S. Pat. No. 4,561,350 granted Dec. 31, 1985; U.S. Pat. No. 4,474,108 granted Oct. 2, 1984; and U.S. Pat. No. 4,606,265 granted Aug. 19, 1986.

A great majority of these prior art devices utilize a reciprocating ram which slides in a semicylindrical compaction chamber driven by a ram rod or connecting rod pivoted to a crank arm extending radially outwardly from a crankshaft. See the aforementioned U.S. Pat. Nos. 3,817,169; 4,561,350; 4,474,108; and 4,606,265, for example.

A common design problem in all such apparatus has been the means for delivering the cans to be crushed one at a time into the compaction chamber. The solution to this problem has, heretofore, resulted in bulky, cumbersome, expensive apparatus which occupies an unwarranted amount of space for accomplishing a necessary but relatively minor income producing and metal reclaiming function.

All of the prior art patents referred to above are designed to be freestanding, thus taking up floor space or counter space.

What was lacking before the present invention was an aluminum can crusher which can either be freestanding on a countertop or floor where space is available or can be supported on the top rim of a garbage can or cylindrical trash can or the like. Also lacking was such a crusher which ran on a continuous cycle, into which cans could be inserted at any point in that cycle, and whereby the timing for admitting plural cans into a compression chamber one at a time is accomplished directly from a crankshaft crank arm structure by the simple expedient of immobilizing by impaling the next-to-be-crushed can until the can between the ram and the anvil is crushed and allowed to drop from the apparatus.

SUMMARY OF THE INVENTION

In a crusher for elongate cans where the cans are crushed between a ram and an anvil plate, the ram is reciprocated by a power train including a ram rod extending from the ram, a ram rod crank arm pivoted to the ram rod, and a power rotated crankshaft supporting the ram rod crank arm. Crushed cans are ejected from between the ram and the anvil plate after being crushed, and uncrushed cans are fed from a feed tube to a lengthwise position between the ram and anvil plate, one at a time, each time the ram moves back from the anvil plate.

This invention is an improvement on such a can crusher wherein a skewer crank arm is fixedly mounted to the crankshaft in fixed angular relationship with respect to the ram rod crank arm, the feed tube is provided with a skewer receiving opening and a skewer retaining sleeve extends outwardly from the feed tube in surrounding relationship to that opening, a pointed skewer is pivotally mounted at its first end to the skewer crank arm and its second opposite pointed end is positioned in encompassed relation to the skewer retaining sleeve.

Means is provided to restrict an uncrushed can from leaving the feed tube and entering into a position on the other side of the ram from the anvil plate.

The angular relationship between the ram rod crank arm and the skewer crank arm is such that when the ram is in its closest position to the anvil plate, the skewer is clear of the interior surface of the feed tube to allow uncrushed cans to move into contact with the can restricting means and is such that before the bottom can passes clear of the can restricting means and into lengthwise position between the anvil plate and the ram, the next-to-the bottom uncrushed can has been impaled by the skewer.

At the present time, there is an emphasis on recycling aluminum cans, and the invention set out herein is particularly suited for that work. However, even at the present time, and perhaps more economically important at some time in the future, this invention can be used to crush cans having frangible side walls and being made of other materials, such, for example, as steel. Prototypes of the present invention have worked perfectly well in crushing steel beverage cans. If and when it becomes more important to salvage steel cans, the only modifications needed to the present apparatus would be an increase in the horsepower of the drive motor and/or a change in the back gearing of the motor to develop more power.

DETAILED DESCRIPTION OF THE PREFERRED EMBODIMENTS

Figure 1:
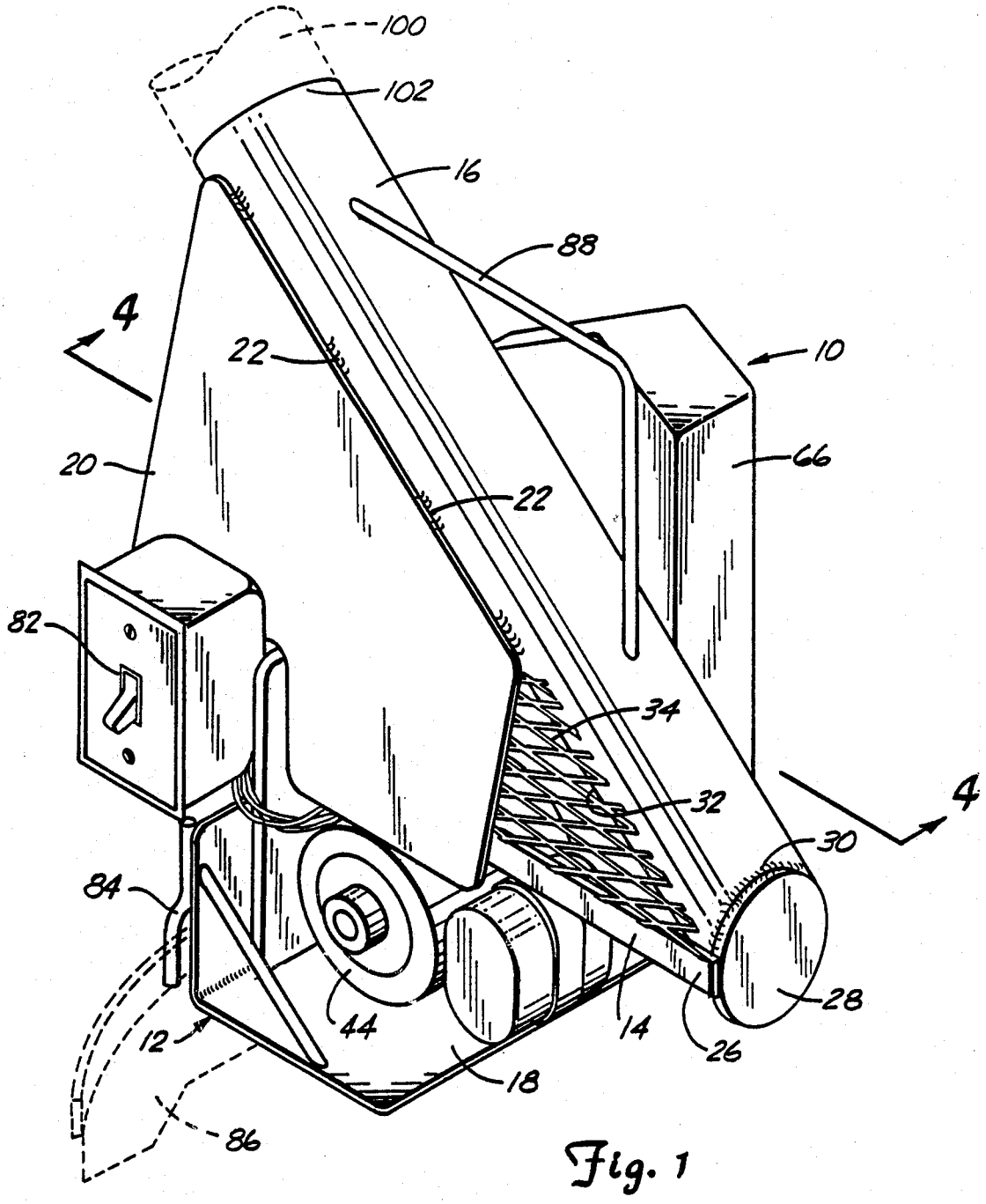
FIG. 1 is a perspective view of a can crusher made according to the present invention showing its relationship to the rim of a trash can or garbage can (shown in phantom) and showing a can to be crushed (shown in phantom) being fed into the crusher.
Figure 2:
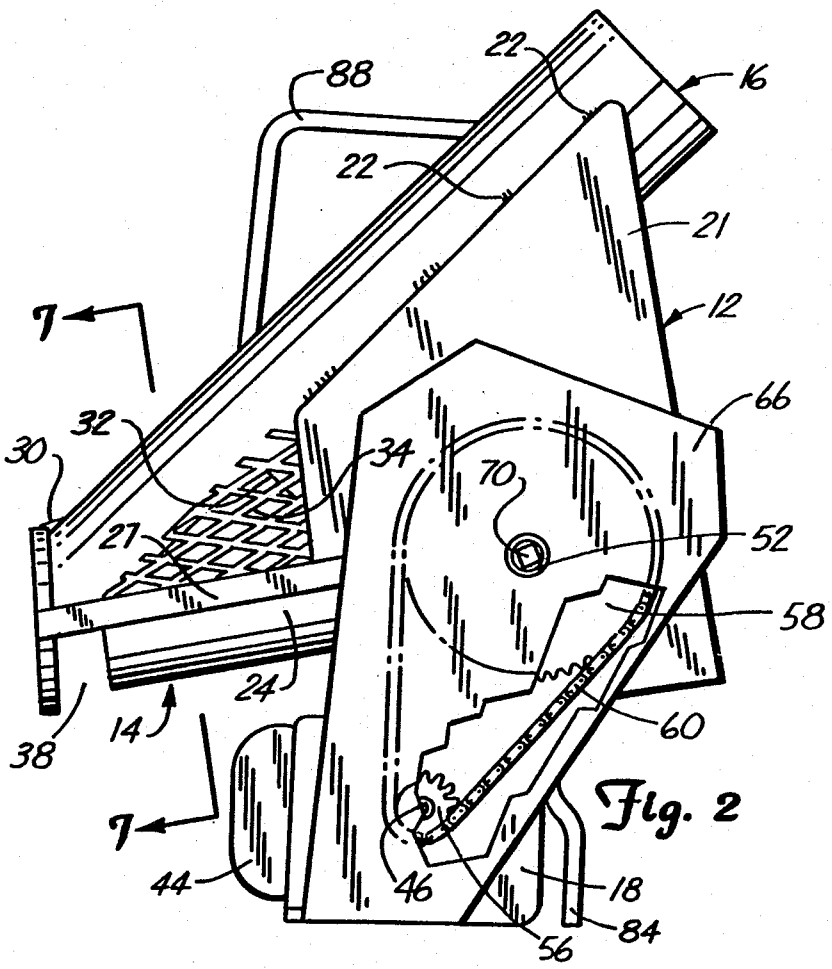
FIG. 2 is a side elevational view of the can crusher of FIG. 1 as seen from the right rear side of FIG. 1.

A can crusher 10 includes a main frame 12, a semicylindrical upwardly opening compaction chamber 14 integrally mounted to the main frame, a cylindrical can holding feed tube 16 mounted to the main frame and positioned to deliver cans to be crushed into the compaction chamber.

Main frame 12 includes an L-shape base 18 and a pair of mutually parallel side plates 20 and 21 extending integrally upwardly from the base 18. Upper edges of the side plates support the feed tube 16 by welding, for example, as at 22.

The compaction chamber 14 includes a semicylindrical casing 24, a pair of mutually parallel reinforcing bars 26 and 27 integral with upper edges of the casing 24, each welded to one of the side plates 20 and 21, respectively, and each welded to and extending integrally outwardly from the top of the L-shape base 18. The compaction chamber terminates at its outer end in an anvil plate 28 to which the reinforcing bars 26 and 27 have been welded. The anvil plate is also welded to the outer end of the cylindrical feed tube 16 as at 30. The internal diameter of the chamber 14 and casing 24 will be no less than the diameter of the thickest can to be crushed.

Figure 6:
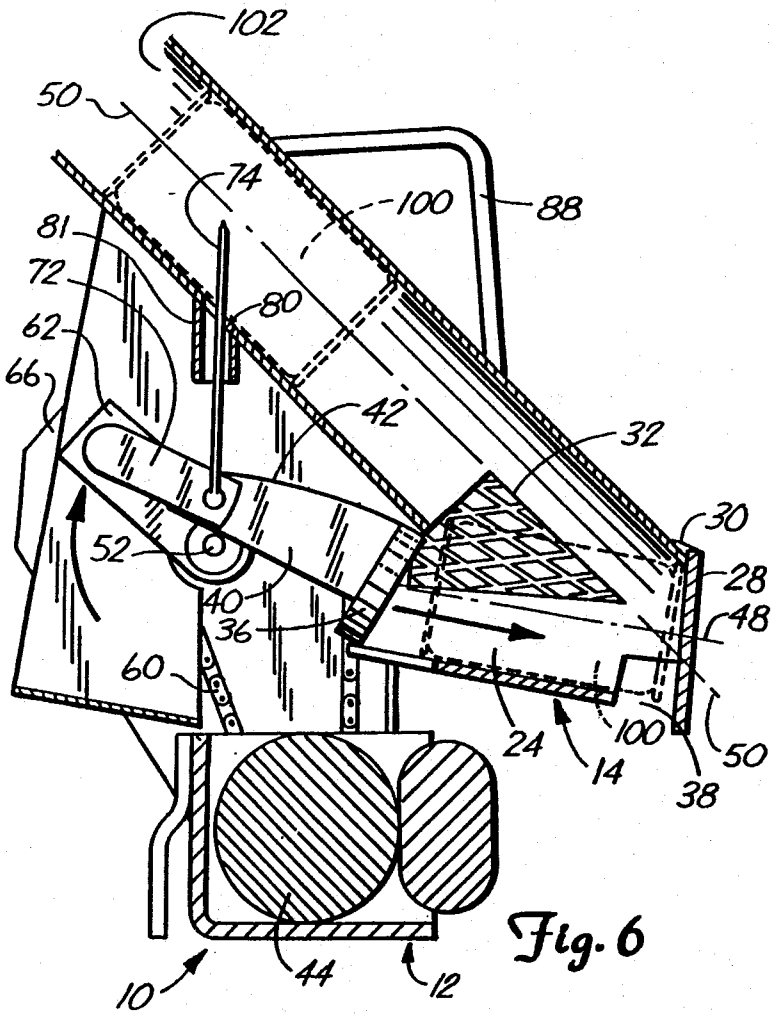
FIGS. 4, 5 and 6 are fragmentary vertical sectional views taken on the line 4—4 in FIG. 1, but showing the movable elements of the invention in three different positions.
Figure 7:
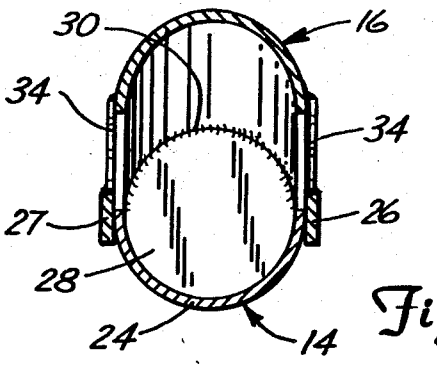
FIG. 7 is an enlarged vertical sectional view taken on the line 7—7 in FIG. 2.
Figure 5:
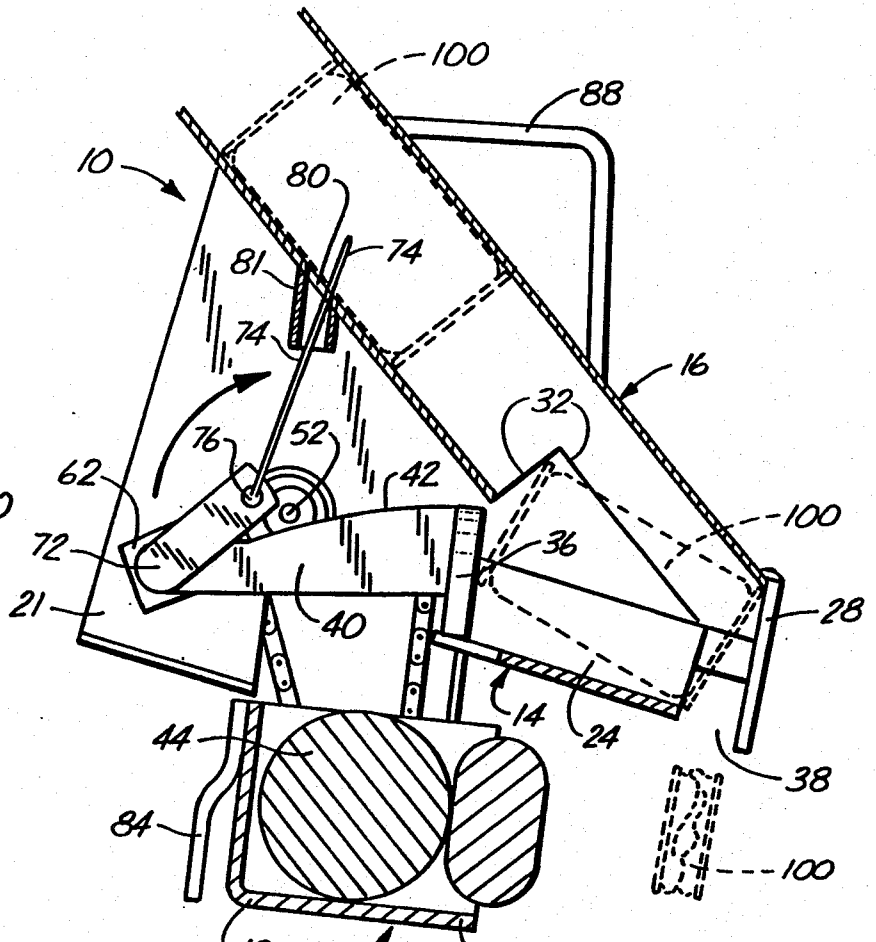
Figure 4:
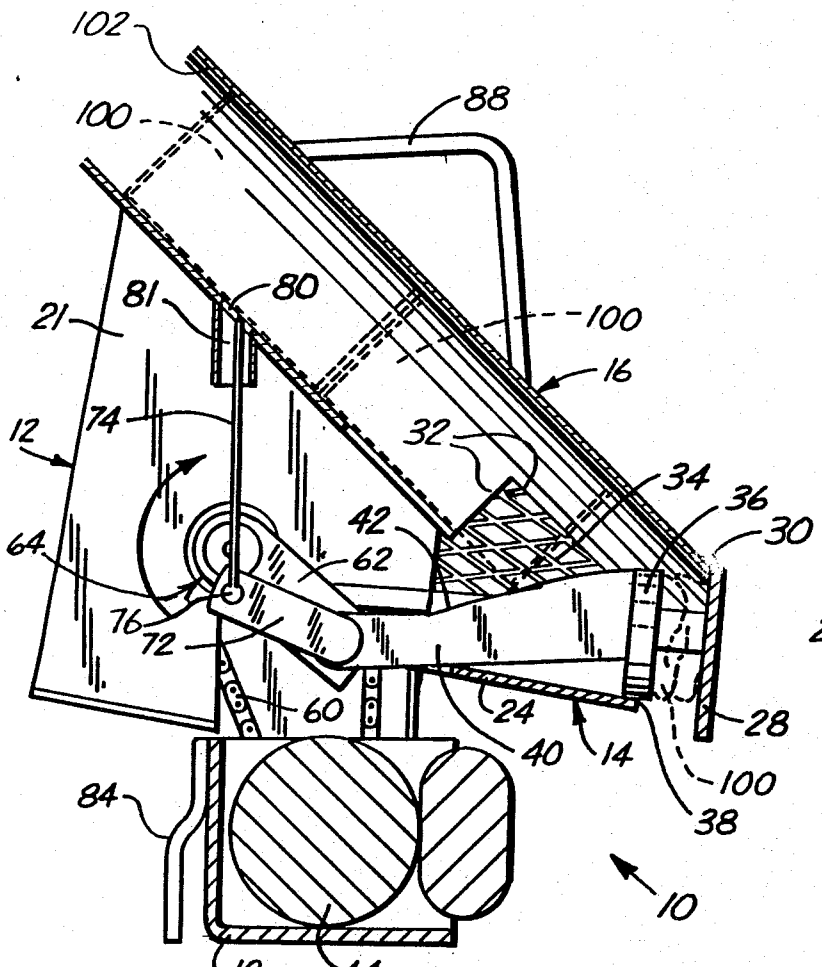

As best seen in FIGS. 4, 5 and 6, feed tube 16 is cut away as at 32 to provide an opening through which cans to be crushed can drop from the feed tube into the compaction chamber 14. The diameter of the feed tube can approximate that of the cans to be crushed so long as there is sufficient clearance between the tube and can to let the cans fall freely in the tube by action of gravity.

Expanded metal panels 34,34 form observation windows and are an extension of side plates 20 and 21. These panels 34 are welded to feed tube 16 and to upper edges of the reinforcing bars 26 and 27. In the unlikely event of a jam, the operator can see through these panels to determine the nature of the problem and the cure.

The crushing of each individual can when positioned in the compaction chamber 14 is accomplished by driving a ram 36 toward the anvil plate 28 until the can is crushed. The ram is driven between a first position spaced from the anvil plate by at least the length of the longest can to be crushed and a second position spaced from the anvil plate at a distance no less than the final axial dimension of the bulkiest can to be crushed.

As best seen in FIGS. 4, 5 and 6, a can discharge opening 38 is provided in the semicylindrical casing 24 of the compaction chamber in adjacent relation to the anvil plate 28 to allow the crushed can to drop as the ram is retracted.

A ram rod 40 extends integrally from the ram in direction opposite the anvil plate 28. For a function to be described below, this ram rod is provided with a can restraining camming surface 42 which is flush with the top of the ram 36.

To drive the ram 36 from about the position as seen in FIG. 6 toward the position as seen in FIG. 4 and then to drive it to retract from the position approximately as seen in FIG. 4 to the position as seen in FIG. 5, the following drive train is provided. A back geared motor 44 is mounted to the main frame 12 and drives a motor driven shaft 46, the axis of which is at right angles to a plane defined by a longitudinal extending axis 48 of the semicylindrical casing 24 of the compaction chamber 14 and a second longitudinal axis 50 of the cylindrical feed tube 16.

A crankshaft 52 is journaled in an elongated crankshaft bearing 54 which is fixedly mounted with respect to the main frame 12 to position the crankshaft axis parallel to the axis of the motor driven shaft. A motor shaft pinion 56 is integral with the motor driven shaft 46, and a crankshaft drive sprocket 58 is integral with the crankshaft 52. A drive belt such as endless roller chin 60 operably connects between pinion 56 and drive sprocket 58. A ram rod crank arm 62 extends outwardly from the crankshaft 52 and is provided with a crank arm pivot pin 63 which is pivotally mounted as at 64 to an end of the ram rod 40 spaced from the ram.

A gear case 66 covers the sprocket, pinion and rive chain and is removably fastened to the main frame by bolts 68. An opening is provided in the outer face of the gear case. The crankshaft 52 extends out through this opening and has a bolt-like head 70 thereon. This structure is provided so that if the unlikely jam happens, or for any other reason the ram needs to be backed off or moved forward without the use of motor power, a wrench applied to the head 70 can be used to accomplish this purpose.

Figure 8:
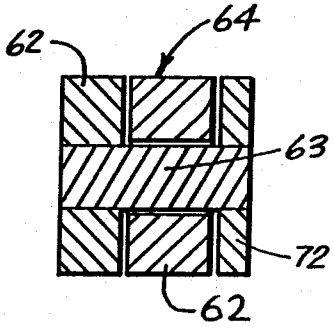
FIG. 8 is an enlarged sectional view taken on the line 8—8 in FIG. 3.

In addition to the ram rod crank arm 62, a skewer crank arm 72 is provided. In the form of the invention as shown, this skewer crank arm is fixedly mounted with respect to the outer end of the ram rod crank arm 62 and the crank arm pivot pin 63 and extends inwardly therefrom. A thin, stiff, pointed skewer 74 is pivotally mounted as at 76 to the skewer crank arm 72. As best seen in FIG. 8, the pivot pin 63 is somewhat in the nature of a wrist pin, integral with the ram rod crank arm 62 and also with the skewer crank arm 72. The ram rod 40 pivots on pin 63. Exactly the same effect could be obtained, of course, by providing a separate skewer crank arm extending outwardly from the crankshaft and pivotally supporting the skewer at the outer end of that crank arm.

The cylindrical feed tube 16 is provided with a skewer receiving opening 80, and a skewer retaining sleeve 81 extends integrally outwardly from the feed tube 16 in encompassing relation to that opening. As seen in FIGS. 4, 5 and 6, the skewer 74 is positioned inside of the retaining sleeve 81 and is of a length such that it will always be retained inside of the sleeve.

The motor 44 is provided with an on/off switch 82 which is mounted to the main frame 12.

Extending downwardly from a top edge portion of the vertical leg of the L-shape base 18 are a pair of support brackets 84,84. These brackets open outwardly and downwardly to be able to receive a top edge portion of a trash can or a garbage can 86. When so situated, as illustrated in FIG. 1, cans to be smashed can be fed continuously into the crusher when the motor is running, and they will drop from the crusher into the can. When the trash can is full, it can be used to transport the crushed cans for recyling without the necessity for ever having to handle the crushed cans further. This is particularly advantageous when the empty beverage cans have not been rinsed out before being crushed and are, therefore, partially covered with a sticky syrup resulting from the evaporation of liquid remaining in the can after it has been used.

As shown, the bottoms of the support brackets 84,84 are flush with the bottom surface of the L-shape base 18 of the main frame so that they tend to add to the stability of the crusher when it is set on a flat surface, while still supplying off center main support when hooked over the top edge of a cylindrical trash can or trash cart.

To increase the capacity of the can crusher to handle larger numbers of cans at a single loading, a feed tube extension (not shown) having the same internal diameter as the feed tube 16 will be slipped over the top of the feed tube.

As an aid to handling the can crusher from position on a flat horizontal surface to and from position on edge of a waste can or cylindrical carton 86, a hand hold or handle 88, extending integrally upwardly from the upper surface of the can holding feed tube 16 is provided.

The gear case 66 is provided, of course, to insure that persons operating the crusher or persons near it cannot be harmed, nor the crusher damaged by intrusion into the drive train.

Figure 3:
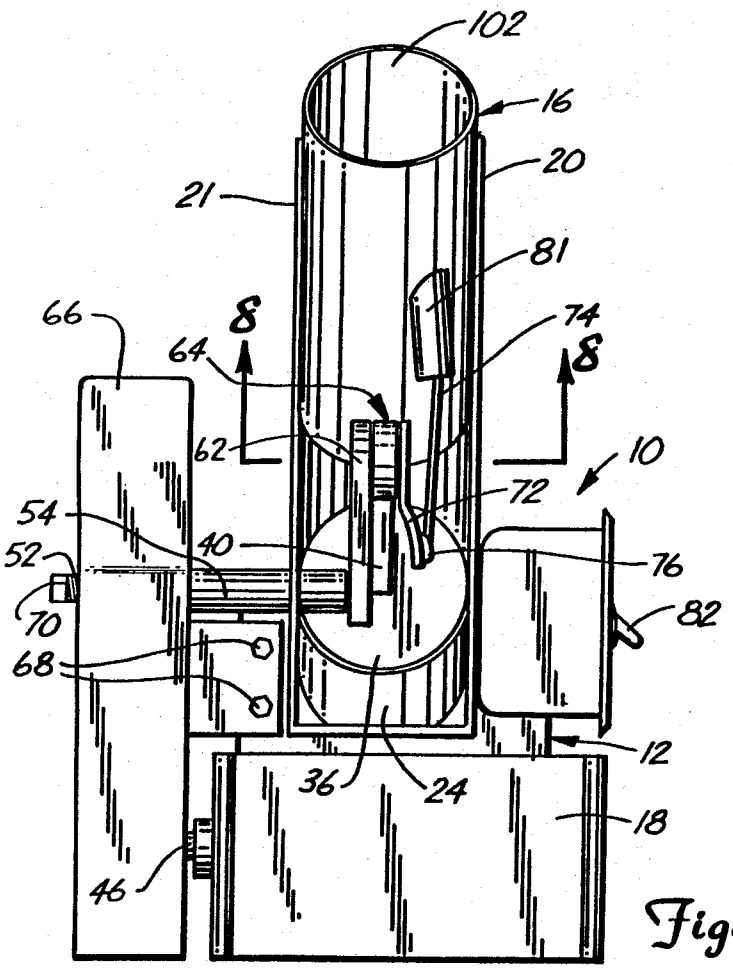
FIG. 3 is a rear elevational view of the crusher of FIGS. 1 and 2 as seen from the left rear side of FIG. 1.

While FIG. 3 shows the ram, ram rod, ram rod crank arm, skewer crank arm and the skewer (all moving parts), it is to be understood that all of these parts are situated between the side plates 20 and 21. See FIGS. 4, 5 and 6. The actual crusher of the invention is provided with a safety panel which is pivotally mounted to the bottom left-hand corner of the side plates as seen in FIGS. 4, 5 and 6, and is then bolted in place covering the opening shown in FIG. 3. This safety panel has been omitted from the drawings for clarity of illustration and explanation.

The interrelationship of the parts of the can crusher can perhaps best be described in relation to its cycle of operation.

OPERATION

Operation of the can crusher can be initiated at any point in that cycle. That is to say that cans such as 12 ounce aluminum beverage cans 100, shown in phantom throughout, can be introduced into the top open end 102 of the feed tube 16 without regard to whether switch 82 is closed and the motor and moving parts are going through their cycle or whether the switch is open, and all of the parts are at rest.

As seen in FIGS. 4, 5 and 6, the bottommost edge of the ram 36 always rides in contact with the interior of the bottom surface of the semicylindrical casing 24 of the upwardly opening compaction chamber 14. This happens because the ram rod fits loosely between the rod crank arm 62 and the skewer crank arm 72 and fits loosely on the crank am pivot pin 63, and because of the massive weight of the ram 36 itself.

Beginning with the parts of the machine positioned as seen in FIG. 4, a crushed can 102 is situated between the anvil plate 28 and the ram 36 and the ram has just passed its closest position to the anvil plate and is just starting to move away from it. Assuming for clarity of explanation that the can crusher is stopped at that position, and first and second uncrushed cans 100 have been introduced through the open end 102 of the feed tube 16. The first such can slid clear down the feed tube until the lower edge of the can rested on the camming surface 42 of the ram rod 40 so that when the second cam 100 was introduced into the tube, it rested on the top end of the first can, all as seen in FIG. 4.

Now switch 82 can be closed, and the crusher will begin to operate by moving the ram rod crank arm 62 and the skewer crank arm 72 in clockwise direction around the axis of the crankshaft 52 causing the ram to retract toward the position as seen in FIG. 5 allowing the first can to tend to drop into the compaction chamber 14. As seen in FIG. 4, however, long before the first can clears the can restraining camming surface 42 of the ram rod 40, the second can in the chute will be impaled by the skewer 74, thus preventing any longitudinal movement of that can along the feed tube until the skewer is withdrawn.

The parts are positioned in FIG. 5 with the ram still moving away from the anvil plate, and just before the first can takes its position concentric with the semicylindrical casing 24 of the compaction chamber 14.

As the parts continue to cycle, the first can will fall into position in the compaction chamber, and, shortly after positioning of the parts seen in FIG. 6, the ram 36 will move forward against the first can and keep moving until it has crushed it completely and the parts are once again at the position as seen in FIG. 4.

Note, however, that the anvil plate 28 is not precisely at right angles to the first longitudinally extending axis 48 of the semi-cylindrical casing 24; and note that the face of the ram positioned as seen in FIG. 6 is also at an acute angle with respect to this longitudinal axis 48. As the ram moves against the first can from the position as seen in FIG. 6 to the position as seen in FIG. 4, it and the anvil plate will initially collapse the top edge of the can, causing that portion of the can wall between these points of contact to collapse first, and the rest of the can wall to collapse progressively from that point as the ram moves forward. This tends to reduce the maximum amount of force needed to start the initial crushing of the can as it eliminates the necessity for the force applied by the ram to be sufficient to overcome the total initial compressive strength of the side wall such as would be necessary if the face of the ram and of the anvil plate were in parallel relationship to each other and at right angles to the axis of the compaction chamber.

As the parts move from the position of FIG. 6 toward the position of FIG. 4, a point will be reached where the crank arms will have caused the skewer to withdraw from inside of the second can and into clearing relationship with respect to the inner surface of the cylindrical feed tube. At that point, the second can is free to move by gravity down the feed tube until it, in turn, rests on the can restraining camming surface 42 of the ram rod 40. If a third uncrushed can has by then been put into the feed tube, it will fall down the tube until it hits the back end of the second can, and will stay there until the mechanism moves from the positions shown in FIG. 4 toward the positions of FIG. 5, at which point, this third can will be impaled, the now second can will fall into the compaction chamber 14, and the cycle will continue.

Although the present invention has been described with reference to preferred embodiments, workers skilled in the art will recognize that changes may be made in form and detail without departing from the spirit and scope of the invention.

What is claimed is:

1. A crusher for elongate cans having frangible side walls, said crusher including:

(a) a main frame;

(b) a semicylindrical compaction chamber integrally mounted to said frame, said chamber being open upwardly and having a first open inner end, a second outer end and a first longitudinally extending axis, the inner diameter of said chamber about said axis being at least as large as the outer diameter of the thickest can to be crushed;

(c) an anvil plate rigidly mounted to the frame in transverse aligned relation to the second outer end of the chamber;

(d) a ram mounted to slide in said chamber between a first position spaced from the anvil plate by a distance at least sufficient to permit the longest can to be crushed to enter the chamber lengthwise and a second position spaced from the anvil at a distance no greater than the final axial dimension of the bulkiest can to be crushed;

(e) said chamber being provided with a bottom opening adjacent the anvil plate, said opening being of size and configuration to allow a crushed can to move by gravity from the chamber after it has been crushed and as said ram begins to move from said second toward said first position;

(f) means for driving the ram between its first and second positions, said means including a ram rod extending integrally from the ram in direction away from the anvil plate;

(g) a cylindrical can holding feed tube for receiving, end to end, a plurality of cans to be crushed, said feed tube having a second longitudinal axis, the feed tube being supported on said frame so that its second longitudinal axis lies in the same vertical plane and above the first longitudinal axis of the compaction chamber, said tube opening into the compaction chamber in position so that a can to be crushed can pass by gravity down the feed tube and into the chamber to position adjacent the anvil plate, the second longitudinal tube axis lying at an acute angle with respect to the horizontal and at an acute angle with respect to and above the first longitudinal compaction chamber axis, said feed tube being provided with a skewer receiving opening therein;

(h) said means for driving the ram including:

(1) a motor mounted on said frame and having a motor driven shaft lying in normal relation to a vertical plane defined by said first and second axes, (2) a motor pinion on the motor driven shaft, (3) a crankshaft rotatably mounted on frame in parallel relation to the motor driven shaft, (4) a crankshaft drive sprocket on said crankshaft, (5) a drive belt operably connecting the motor pinion and the drive sprocket, and (6) a ram rod crank arm extending radially outwardly from the crankshaft and pivotally connected at its outer end portion to the end of the ram rod opposite the ram;

(i) wherein said ram rod is provided with a can restraining camming surface flush with an uppermost end of the ram and extending back toward the ram rod crank arm to lie in can restraining position to prevent a can from taking position on a side of said ram opposite said anvil plate;

(J) means for feeding one can at a time from the feed tube into the compaction chamber each time a can is crushed and dropped from the chamber, said feed means including:

(1) a skewer crank arm extending effectively radially outwardly with respect to the crankshaft to lie in fixed angular relation to the ram rod crank arm about said crankshaft, (2) a pointed skewer pivotally mounted with respect to the skewer crank arm in spaced relation to the axis of the crankshaft and extending outwardly from the skewer crank arm in alignment with the skewer receiving opening of the feed tube, and (3) a skewer retaining sleeve extending integrally outwardly from the feed tube in encompassing relation to the feed tube skewer receiving opening and in encompassing relation to an outer end portion of the skewer; and (k) wherein the angle between the skewer crank arm and the ram rod crank arm is such that when the ram is in its second position the skewer is clear of the interior surface of the feed tube to allow the bottom uncrushed can in the tube to move into contact with the can restraining camming surface of the ram rod, and is such that before that bottom can slides over the camming surface of the ram rod and the ram to move into the compaction chamber, the next-to-the bottom uncrushed can has been impaled by the skewer.

2. The can crusher of claim 1 wherein:

(l) the bottom surface of the ram slides on the interior surface of the semicylindrical compaction chamber as the ram moves between its first position and its second position;

(m) the axis of the crankshaft is positioned above the first longitudinally extending axis of the compaction chamber so that when the ram begins to move from its first toward its second position, the uppermost portion of the ram extends forwardly of the lowermost portion thereof so that the end of can in the chamber adjacent the ram is first crushed at its uppermost portion by the ram, the crushing action then proceeding progressively until this entire end surface of the can is in contact with the ram and continues until the can is completely crushed.

3. The can crusher of claim 2 wherein:

(n) the face of the anvil plate lies at an acute angle with respect to a plane normal to the first longitudinally extending axis of the compression chamber.

4. The can crusher of claim 3 wherein:

(o) the uppermost portion of the anvil plate is closer to the adjacent end of can lying lengthwise in the compaction chamber than are lower portions of the anvil plate so that the upper portion of the can end adjacent the anvil plate will be crushed first with the crushing proceeding progressively until the entire end of the can is in contact with the anvil plate and continuing until the can is completely crushed, and to the end that when a can is completely crushed and the ram begins to move away from it, there will be more clearance at the bottom of the compaction chamber than at the top assuring a rapid discharge by gravity of the crushed can through the chamber bottom opening.

5. A crusher for elongated cans having frangible side walls, said crusher including:

(a) a main frame;

(b) a compaction chamber rigidly mounted to said frame, said chamber being open upwardly and having a first longitudinally extending axis;

(c) an anvil plate rigidly mounted to the frame in blocking relation to an outer end of the chamber;

(d) a ram mounted to slide in said chamber between a first position spaced from the anvil plate at a distance at least sufficient to permit the longest can to be crushed to enter the chamber lengthwise, and a second position spaced from the anvil a predetermined distance no greater than the desired final axial dimension of the bulkiest can to be crushed;

(e) means for discharging cans from the compaction chamber after they have been crushed;

(f) means for driving the ram between its first and second positions;

(g) a can holding feed tube for receiving end-for-end, holding, and dispensing one at a time, a plurality of cans to be crushed, said feed tube being supported on said frame above the compaction chamber in position and of configuration such that a can to be crushed can pass down the feed tube into the chamber to lengthwise position adjacent the anvil plate, said feed tube being provided with a skewer receiving opening therein;

(h) said means for driving the ram including:
  (1) a motor mounted on said frame and having a motor driven shaft,
  (2) a crankshaft rotatably mounted on the frame on an axis which is in normal relation to a vertical plane encompassing said first longitudinally extending axis of said compaction chamber,
  (3) a crankshaft drive sprocket on the crankshaft,
  (4) a drive train operably connecting the motor driven shaft and the crankshaft drive sprocket,
  (5) a ram rod crank arm extending radially outwardly from the crankshaft, and a ram rod extending integrally from the ram in direction away from the anvil plate, said ram rod being pivotally connected at an outer end portion of the ram rod crank arm;

(i) wherein means is provided for restraining a can from leaving the feed tube to take position on a side of the ram opposite the anvil plate;

(j) wherein means is provided for feeding one can at a time from the feed tube into the compaction chamber between the ram and the anvil plate after each succeeding can is crushed and discharged from he chamber, said feed means including:
  (1) a skewer crank arm extending effectively radially outwardly with respect to the crankshaft to have a fixed angular relationship with respect to the ram rod crank arm,
  (2) a pointed skewer pivotally mounted with respect to the skewer crank arm in spaced relation to the axis of the crankshaft and extending outwardly from the skewer crank arm in alignment with the skewer receiving opening of the feed tube, and
  (3) a skewer retaining sleeve extending integrally outwardly from the feed tube in encompassing relation to the feed tube skewer receiving opening and in encompassing relation to an outer end portion of the skewer; and (j) wherein the angular relationship between the ram rod crank arm and the skewer crank arm with respect to the crankshaft axis is such that when the ram is in its closest position to the anvil plate, the skewer is clear of the interior surface of the feed tube to allow the bottom uncrushed can in the feed tube to move into contact with the can restraining means, and is such that before the bottom can passes clear of the can restraining means and into lengthwise position in the compaction chamber, the next-to-the bottom uncrushed can has been impaled by the skewer.

6. In a crusher for elongate cans wherein the cans are crushed between a ram and an anvil plate, the ram being reciprocated by a ram rod extending from the ram and ram rod crank arm pivoted to the ram rod and rotated by a crankshaft; crushed cans being ejected from between the ram and the anvil plate after being crushed; and uncrushed cans being fed from a feed tube to a lengthwise position between the ram and plate, one at a time, each time the ram moves back from the anvil plate; the improvement wherein:

(a) a skewer crank arm is fixedly mounted to the crankshaft in fixed angular relationship with respect to the ram rod crank arm;

(b) the feed tube is provided with a skewer receiving opening and a skewer retaining sleeve extends outwardly from the feed tube in surrounding relationship to said opening;

(c) a pointed skewer is pivotally mounted at a first end to the skewer crank arm and its second opposite pointed end is positioned in encompassed relation to the skewer retaining sleeve;, (d) means is provided to restrain an uncrushed can from leaving the entrance of the feed tube and entering into a location on the side of the ram opposite the anvil plate; and (e) the angular relationship between the ram rod crank arm and the skewer crank arm is such that when the ram is in its closest position to the anvil plate, the skewer is clear of the interior surface of the feed tube to allow uncrushed cans to move into contact with said can restricting means and is such that before the bottom can can pass clear of the can restricting means and into lengthwise position between the anvil plate and ram, the next-to-the bottom uncrushed can has been impaled by the skewer.

* * * * *

UNITED STATES PATENT AND TRADEMARK OFFICE

CERTIFICATE OF CORRECTION

PATENT NO. : 4,821,969

DATED : April 18, 1989

INVENTOR(S) : Vernon J. Fox et al.

It is certified that error appears in the above-identified patent and that said Letters Patent is hereby corrected as shown below:

Column 6, line 60, after "transverse" insert --,--.

Column 9, line 28, delete "he", insert --the--.

Signed and Sealed this

Third Day of October, 1989

*Attest:*

*Attesting Officer*

DONALD J. QUIGG

*Commissioner of Patents and Trademarks*